US010967420B2

(12) United States Patent
Bach

(10) Patent No.: US 10,967,420 B2
(45) Date of Patent: Apr. 6, 2021

(54) METHOD AND MOLD TOOL OR CORE TOOL FOR PRODUCING MOLDS OR CORES

(71) Applicant: Soplain GmbH, Sülzetal (DE)

(72) Inventor: Wolfram Bach, Welsleben (DE)

(73) Assignee: SOPLAIN GMBH

( * ) Notice: Subject to any disclaimer, the term of this patent is extended or adjusted under 35 U.S.C. 154(b) by 74 days.

(21) Appl. No.: 16/466,319

(22) PCT Filed: Nov. 20, 2017

(86) PCT No.: PCT/DE2017/100995

§ 371 (c)(1),
(2) Date: Nov. 29, 2019

(87) PCT Pub. No.: WO2018/103784

PCT Pub. Date: Jun. 14, 2018

(65) Prior Publication Data

US 2020/0188988 A1 Jun. 18, 2020

(30) Foreign Application Priority Data

Dec. 6, 2016 (DE) ..... 102016224183.4
Sep. 26, 2017 (DE) ..... 102017217096.4

(51) Int. Cl.
*B22C 7/06* (2006.01)
*B22C 9/12* (2006.01)
(Continued)

(52) U.S. Cl.
CPC ..... *B22C 1/10* (2013.01); *B22C 1/02* (2013.01); *B22C 1/18* (2013.01); *B22C 1/188* (2013.01);
(Continued)

(58) Field of Classification Search
CPC ..... B22C 7/06; B22C 7/065; B22C 7/067; B22C 9/12
See application file for complete search history.

(56) References Cited

U.S. PATENT DOCUMENTS 5,715,885 A * 2/1998 Nagarwalla ..... B22C 7/06 164/158
2004/0192806 A1 9/2004 Kuhs

FOREIGN PATENT DOCUMENTS

CN 1538887 10/2004
DE 3735751 5/1989
(Continued)

*Primary Examiner* — Kevin E Yoon
(74) *Attorney, Agent, or Firm* — Isus Intellectual Property PLLC; Anthony Jason Mirabito

(57) ABSTRACT

The invention relates to a method for more quickly producing molds (2) or cores (2') for foundry purposes by adapting the specific electrical resistance in the selection of the core box to the mixture (9) of a molding material and of a water-containing binder, which binder, when dissolved, forms an electrolyte and has a sufficient electrical conductivity. It is essential to the invention that an electrically conductive material (7) for holding the mixture (9) is introduced into an electrically non-conductive housing (3), wherein the specific electrical conductivity of the material (7) at operating temperature (7) at least approximately corresponds to the specific electrical conductivity of the mixture (9) at temperatures between 100° C. and 130° C., and that electrical energy and thus heat are supplied to the material (7) via electrodes (10) arranged in/on the housing (3) (resistance heating principle), leading to curing of the mixture (9). Depending on the sand core, up to 30% shorter cycle times can be achieved.

6 Claims, 3 Drawing Sheets

Figure 1:
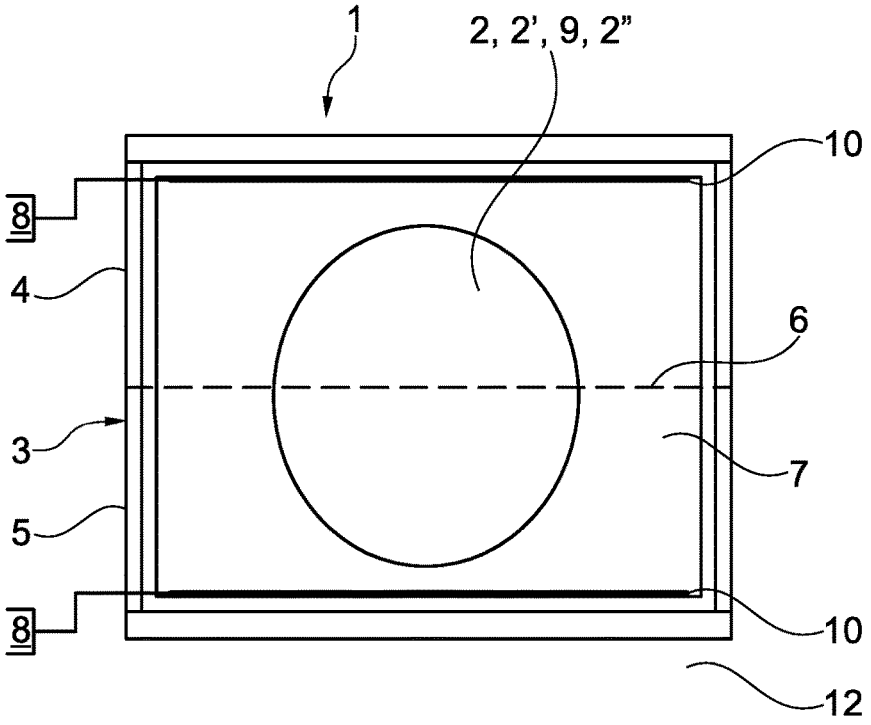

(51) Int. Cl.
*B22C 1/10* (2006.01)
*B22C 1/02* (2006.01)
*B22C 1/18* (2006.01)

(52) U.S. Cl.
CPC ..... *B22C 7/06* (2013.01); *B22C 7/065* (2013.01); *B22C 7/067* (2013.01); *B22C 9/12* (2013.01)

(56) References Cited

FOREIGN PATENT DOCUMENTS

| | | | | | |
|---|---|---|---|---|---|
| GB | 1429837 | A | * | 3/1976 | ..... B22C 9/12 |
| JP | 56151137 | A | * | 11/1981 | ..... B22C 9/12 |
| WO | 03013761 | | | 2/2003 | |

* cited by examiner

METHOD AND MOLD TOOL OR CORE TOOL FOR PRODUCING MOLDS OR CORES

The present invention relates to a method for producing molds or cores for foundry purposes under the use of electricity by adapting the specific electrical resistance of the core-box material to a mixture consisting of a molding material and of a water-containing inorganic binder, which binder, when dissolved, forms an electrolyte and has a sufficient electrical conductivity. The invention furthermore relates to a mold tool or core tool for producing molds or cores.

From WO 2003/013761 A1, a generic method is known where magnesium sulphate is used as an inorganic binder, which is dispersed and/or dissolved into water and then mixed with foundry sand. Then, this mixture consisting of a molding material, meaning, for example, foundry sand and the water-containing binder, is introduced into the mold or core tool and cured there by means of heating. The use of an inorganic binder should prevent an escape of environmentally harmful gases when curing the mixture. Thereby, this application is partly based on the patent application OE 24 35 886 A1 from the year 1974 for curing sand cores by means of "channeling an electric current through them".

In the aforementioned document WO 2003/013761 A1, it is stated that energy required for curing is provided by means of electricity. Thereby, the electricity is applied via two or a plurality of electrodes at "at least partially conductive parts that are insulated from each other of the separable mold or core tools". The aforementioned application does not take the difference between the specific electrical resistance characteristics of the core tool and the specific electrical resistance characteristics of the sand-binder mixture into account. It uses "parts of the separable mold or core tools that are insulated against each other".

From DE 37 35 751 A1, a gas-permeable mold tool for producing casting molds and core forms out of curable foundry sand is known, wherein the tool is composed of a heteroporously structured material with open pores and wherein the wall of the mold tool comprises a first fine-pored layer area abutting the foundry sand with a thickness of 0.2-2 mm, 75-95% of the theoretical material density and a pore diameter of <50 μm, on which a second solid area abuts in a material bonding manner in the form of a large-pore supporting skeleton having <80% of theoretical material density and an average pore diameter of <100 μm.

From DE 24 35 886 A1, a method is known for producing foundry molds or cores by introducing a mixture consisting of an aggregate and a binder into a mold or core box and heating the mixture, wherein the heating is caused by channeling an electrical current through the mixture.

From EP 3 103 562 A1, a stencil is known, which comprises a frame-shaped or box-shaped embodiment preferably being slightly downwardly tapered with a circumferential wall and also a floor in the case of the box-shaped embodiment.

Mold or core tools for inorganic methods are preferably made of metal, such as steel or aluminium for example.

The disadvantage of the aforementioned application is that an insulation layer between the parts of the mold or core tools is required, which should prevent short-circuiting when applying the voltage and should thereby cause the flow of current through the sand/binder mixture.

Another disadvantage of the technique results despite the use of an insulation layer. The electrical current continuously seeks the route with the least level of resistance for balancing the electrical potentials.

Metallic core tools have a resistance range of $2\times10^{-7}$ ohmmeters (steel) for example, wherein sand/binder mixtures are within the range of approximately 101 to 102 ohmmeters. Since the resistance at the core box is considerably lower than in the sand/binder mixture, the current flows up to the contact surface within the core box and is then channeled through the sand/binder mixture over the course of a short route. This results in almost no current flowing on the thicker parts of the sand core and thereby, no sufficient heating takes place. Thereby, no even curing of the mixture results.

If such an only partially cured core is removed from the mold or core tool, this can be damaged or can result in a damage in the case of later using it in a casting tool. Another disadvantage is based on the same principle that electrical current always seeks out the route with the least amount of resistance. In the case of core boxes made of non-conductive material, and two opposite electrodes, the method would therefore only function in the case of geometries with the same sand-core thicknesses. For example, this is the case with cylinders and cuboids. Thereby, the method can only be applied in the case of simple geometrical shapes.

Another disadvantage can be observed during curing by means of heat transfer. Since sand/binder mixtures are generally rather poor heat conductors, during the heat transfer of heated core boxes, scaling results on the outer edges of the sand core since the shell cures rather than the sand core interior. For economic reasons, it is not always waited until full curing takes place before removal in such a way that the sand cores can break more easily.

Another disadvantage results due to the effect of the aforementioned scaling. Since the interior of the sand core is not completely cured due to scaling, this leads to a limiting of the maximum sand-core thicknesses, which can be created using existing methods. The maximum thickness of the sand core depends on the duration of heating as well as the net weight of the sand core. If the heating is not sufficient, the outer shell of the sand core cannot fully support the weight despite fully curing and can therefore result in breakage of the sand core.

The present invention therefore deals with the problem of indicating an improved or at least an alternative embodiment for a generic-type method that, in particular, overcomes the disadvantages known from prior art.

According to the invention, this problem is solved by means of the features of the independent claims. Favourable embodiments are the object of the dependent claims.

The present invention is based in the general idea of taking the specific electrical conductivity into account when selecting the material of the separable mold or core tools in such a way that it approximately corresponds to the electrical conductivity of a (sand/binder) mixture while at the optimal operating temperature. The electrical specific conductivity of the mold or core tool (cavity) is determined by the sand/binder mixture used.

By means of this, the particular effect can be achieved that a current introduced into the material can be found and the approximately identical electrical conductivity can be found everywhere in the mixture, and thereby, no severely shorter, in particular, abridged path through the mixture is sought out, whereby an even flow of electrical current through the mixture and thereby, also even heating can be achieved, thereby, also resulting in an even curing of the same, and that being independent of the respective individual form or shape of the core.

In general, in the case of the method according to the invention, an electrically conductive material is initially introduced on a permanent basis into a housing of the mold or core tool and takes the previously described mixture from a molding material, for example, a binder containing sand (foundry sand) and water, which forms an electrolyte in dissolved form and has a sufficient electrical conductivity.

The present invention is furthermore based on the general idea of indicating a mold or core tool for producing molds or cores, for example, foundry cores, made of a mixture consisting of a binder containing a molding material and a water, which forms an electrolyte in dissolved form and has a sufficient electrical conductivity, wherein the mold or core tool according to the invention possesses a housing that consists of at least two parts and is electrically non-conductive. The mold or core tool also has at least two electrodes, wherein each electrode is arranged within one part of the housing. Via the two parallel electrodes, electrical energy is later channeled into the material and into the mixture via this, whereby the mixture is heated, thereby being cured.

A direct contact of the conductive material and of the electrodes of the core box is necessary for the method. Thereby, an insulation layer between the core-box parts can be done without.

The introduction of the mixture takes place for each cycle of sand-core production, wherein the electrically conductive material is introduced once each time the mold or core tool is produced. The material thereby forms the negative contour of the sand core or mold to be created in it later on. After the mixture is embedded within the material, electrical energy and, via this, heat is then supplied to the material over the electrodes arranged within/on the housing of the mold or core tool, thereby leading to a curing of the mixture.

As is the case with existing patent applications, the housing merely represents a reservoir for holding the conductive material and must not be electrically conductive since the current is otherwise channeled over the housing and not through the material or the mixture. The housing can be made of plastic and offers the advantage that it is comparatively light and therefore easy to handle. Alternatively, an insulating ceramic or other electrically non-conductive material can also be used.

Parts of the housing can thereby be connected to each other via one or a plurality of separating levels, wherein the electrodes are preferably arranged in parallel to one another and can even be embedded within a part of the housing.

In the case of another favourable embodiment, a device for controlling/regulating the electrical voltage applied to the electrodes is provided. By means of such a device, the voltage applied to the electrodes can be regulated, for example, increased so that short cycle times can be achieved for the curing process. Short cycle times, in turn, allow for a comparatively cost-effective production of the molds or cores. The regulation of the power/voltage can take place by means of inverters/power systems or by means of applying different voltages. As an alternative, the method can also be operated by means of continuously applied voltage.

As has already been indicated in DE 24 35 886 A1, the electrical energy in the form of alternating current or direct current can be supplied to the material and the sand/binder mixture. Alternating current is available everywhere and can be regulated in almost any way.

In addition, ventilation slits (orifices) must be provided within the material, in the electrodes as well as within the housing in order to make the escape of gases or water vapour possible. As is the case with existing methods, during the curing process, resulting gases and water vapour can be discharged by means of core prints (orifices) out of the sand core (core) and the material, the electrodes and the housing via holes. Alternatively, the material can also be porous and thus allow the gases or water vapour to escape.

Furthermore, holes for non-conductive ejection pins are provided within the material, which are used for removing the (sand) cores. These allow the removal of the sand cores after curing the mixture and moving apart the housing parts. Thereby, the ejection pins should be made of non-conductive material in order to avoid short-circuiting. Required ejection pins are attached to the base plate of the tool in the designated ejection holes.

As an alternative, conductive ejection pins can also be used, provided that it has been insured on a technical constructive level that these two not have any contact with a power-conducting material while the current is switched on.

By means of the solution according to the invention, according to which the specific electrical connectivity of the material at least approximately corresponds to the specific electrical conductivity of the mixture at operating temperature, an even and, in particular, uniform channeling of current and voltage through both the material as well as through the mixture can be achieved, whereby the latter is evenly heated, thereby being capable of curing in a particularly even and thus high-quality manner.

Several steps are necessary to optimally select electrically conductive materials for this method. Each binder has an optimal operating temperature that ensures the best possible curing. For the tested binders, this was about 150-180° C. and depends on the manufacturer's specifications as well as, possibly, the binder additives used. In comparison to the methods known from prior art up until this point, where it must continuously be feared that the mixture has a different local degree of curing due to different internal electric resistances, for example, caused by different sand-core thicknesses, for the first time, an even, meaning a uniform and additionally process-reliable curing of the mixture can be achieved by means of the method according to the invention, wherein molds or foundry cores can be produced having a particularly high level of quality independent of their geometrical structure. Furthermore, by means of the method according to the invention, the danger of scaling on a core surface or a mold surface is prevented, which, for example, would be the case when curing by means of heat from the outside (e.g. oil heating).

For the first time, by means of the mold or core tool according to the invention, a process-reliable production of molds or cores is thereby possible by means of the adaptation of the specific electrical conductivity of the mold/core-box material to the sand/binder mixture. This allows for the even channeling of electrical energy to take place and, therefore, to even heating, thus resulting in even curing. Up until this point, this was not possible due to the aforementioned disadvantages.

Due to the adaptation of the electrical resistance of the material to the sand/binder mixture, greater and more complicated sand cores can also be produced in an economic way by means of one electrode for each core part since no significant resistance differences result at any point due to sand-core thicknesses by means of different contours.

In addition, by means of adapting the specific electrical resistance depending on sand-core thickness, operations can also take place according to the guidelines of low voltage of up to 1000V. As a result, the method not only has a higher level of safety for employees but is also more cost-effective.

In principle however, higher voltages are also possible as is the case with existing patents. Thereby, it applies that the thicker the sand core is, the higher the voltages to be used should be.

Due to the direct heating of the sand core as well as the material via external heating apparatuses such as oil heaters or water vapour without diversions, the efficiency of the method increases and short heating phases and, thereby, short cycle times result thanks to the even heat supply across the entire surface of the core.

Another advantage results in that no external heating devices are required. This not only increase the efficiency of the method as described above, but also reduces the procurement and maintenance costs for possible external heating apparatuses. In addition, this allows plants with a lower level of space requirement to be provided sot that more plants can tend to be accommodated on the same area.

Another advantage results for the core tool. Existing systems that require heat energy for curing need the heat from the heating source to be supplied as close as possible to the sand core in the core box. This is partially solved by means of complicated heating holes within the base plate or core box. These steps can be completely eliminated because the heat is generated directly where it is needed: In the sand core and core box.

Another advantage results from using materials, such as silicone-carbide ceramic, which is a very hard material (Mohs hardness 9.5) in comparison to existing core-tool materials, such as steel or aluminium, thereby prolonging the lifetime of the core box due to a low level of wear.

Thereby, in general, a method according to the invention for producing molds or cores for foundry purposes functions by means of adapting the specific electrical resistance of the material of the tool insert to the specific electrical resistance of a mixture consisting of at least one molding material, in particular, foundry sand, and at least one water-containing inorganic binder that can be cured by means of heat, which has a sufficient electrical conductivity of at least $5\text{-}10^{-3}$ S/m.

Thereby, at least one tool insert made of an electrically conductive material for holding the mixture is introduced into an electrically non-conductive housing, wherein the electrical conductivity of the material at an operating temperature between 150 and 180° C. at least approximately corresponds to the specific electrical conductivity of the mixture at a temperature between approximately 100° C. to 130° C., electrical energy and thus heat is supplied to the tool insert via electrodes that are arranged in parallel in/on the housing and, if required, extend across the entire surface, which leads to the curing of the mixture, the housing is made of at least two housing parts, which are moved together or apart from each other at the beginning and upon completion of the cycle process of the mold or core production and form a direct contact surface without an intermediate insulating layer when moved together, required holes for ejection pins are available within the tool, belonging to at least one electrode as well as to at least one part of the housing for removing the sand core, both the tool as well as the electrodes as well as at least one part of the housing are porous and/or ventilation slits are present for the escape of water vapour or gases, and the mold(s) or the core(s) are pressed out of the tool and removed by means of ejection pins after curing of the mixture and moving apart the housing parts.

Other important features and advantages of the invention result from the subclaims, the drawings and the related figure description based on the drawings.

It is to be understood that the features explained in the aforementioned and following cannot only be used in the respectively indicated combination, but also in other combinations or alone, without departing from the scope of the present invention.

Preferred exemplary embodiments of the invention are represented in the drawings and will be described in more detail in the following description, wherein the same reference numbers will refer to the same or similar or functionally identical components.

On a schematic level respectively, the figures show

Figure 2:
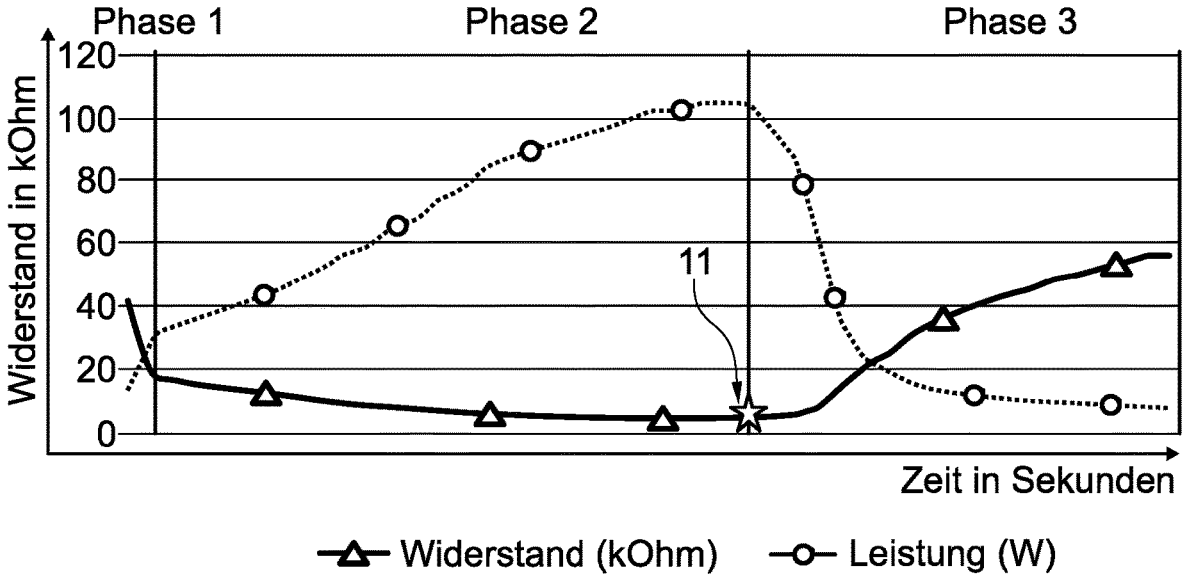
Figure 3:
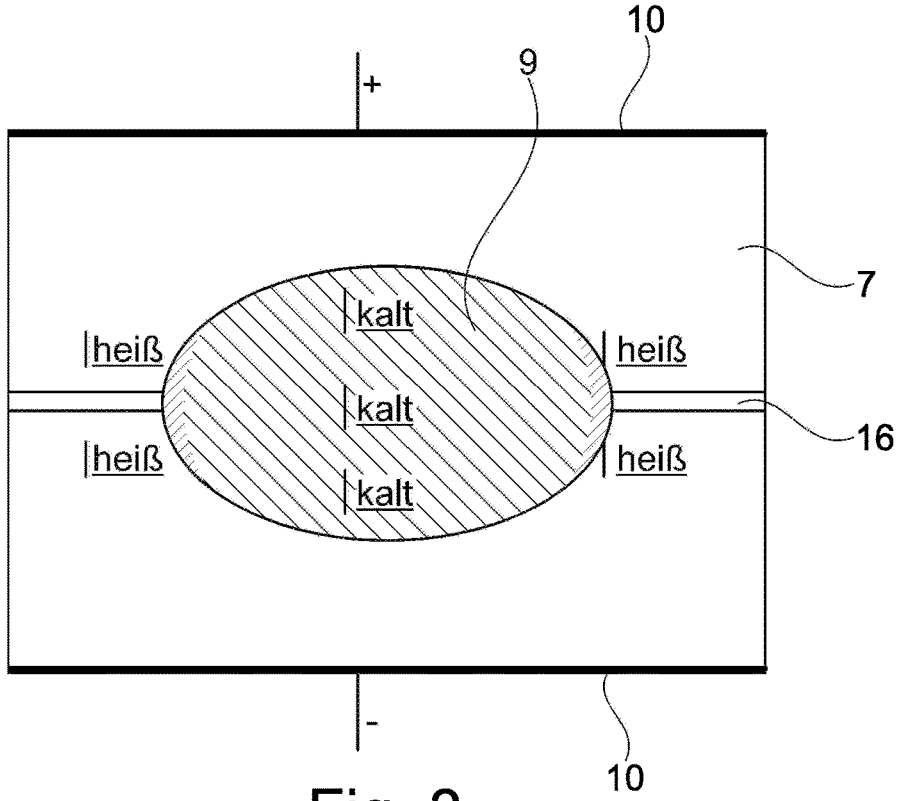
Figure 4:
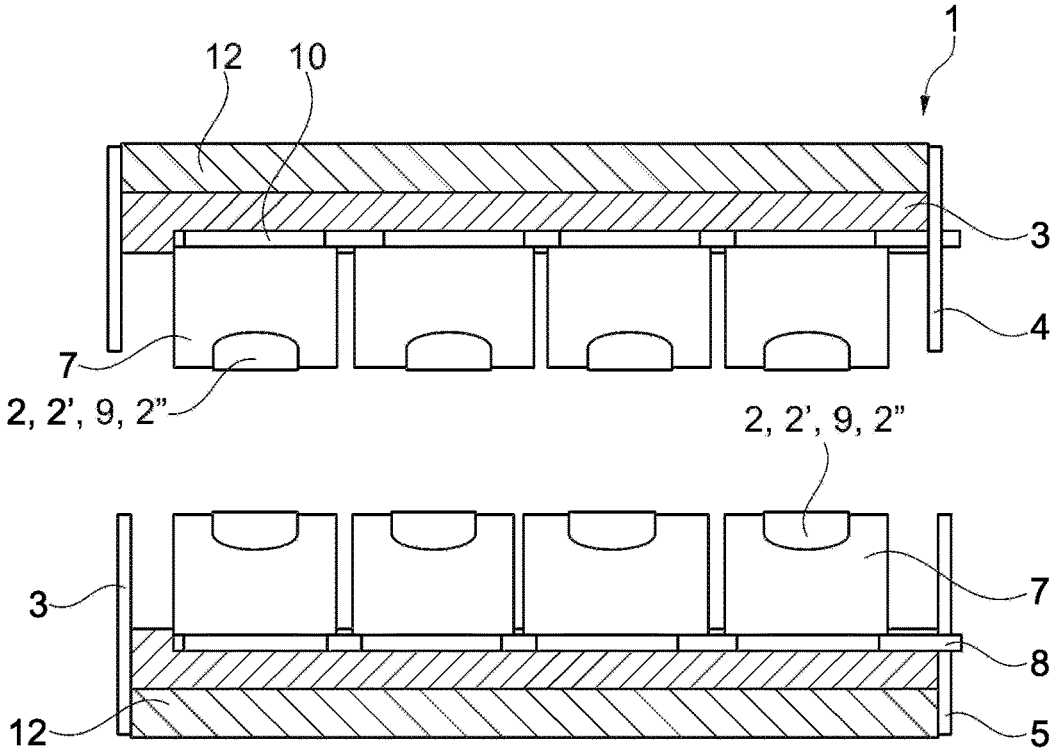
Figure 5:
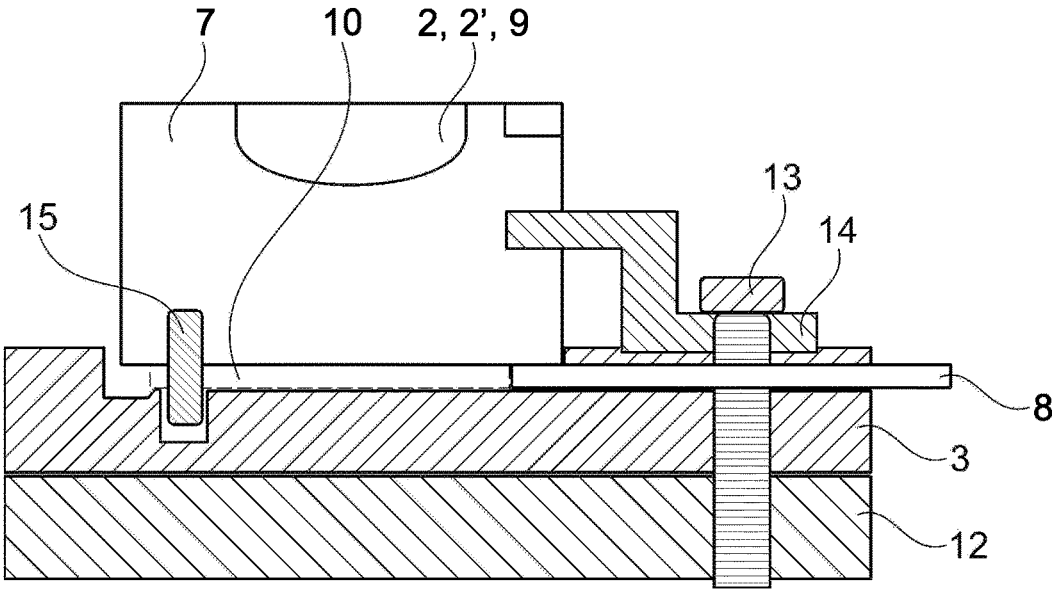
Figure 6:
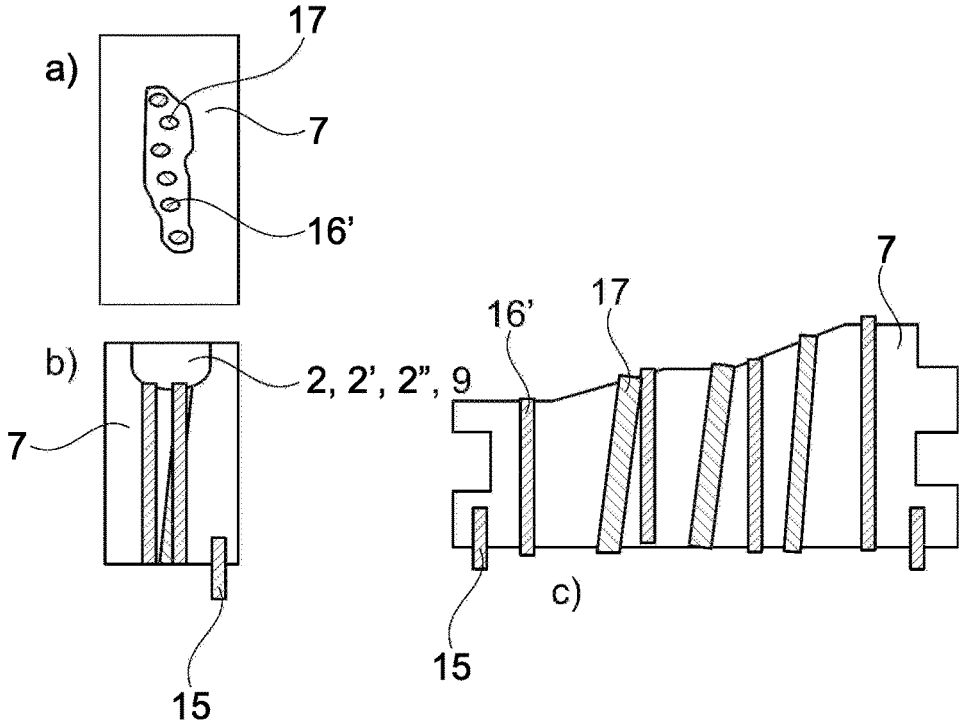

FIG. 1 a cross-sectional illustration through a mold or core tool according to the invention, FIG. 2 a phase diagram with a qualitative view of an introduced electrical power and a related resistance in a core or a mold, FIG. 3 a view of the heating by means of an existing electrical method without adapting the specific of resistance the (core-box) material to the sand/binder mixture, FIG. 4 an illustration of a possible core-box design FIG. 5 an attachment of the material with insulating housing and base plate, FIG. 6 a view of the ventilation and ejection holes with a top view (FIG. 6*a*), a front view (FIG. 6*b*) and a lateral view (FIG. 6*c*).

In accordance with FIG. 1, a mold or core tool 1 according to the invention for producing molds 2 or cores 2 for foundry purposes, a housing 3 that is electrically insulated from the machine, which consists of two parts 4, 5, which are connected to each other via a separation level 6. The housing 3 is attached to a base plate 12. The housing 3 is made of plastic, insulating ceramic or other non-conductive material and takes up an electrically conductive material 7. The material 7 forms a mold to hold a mixture 9, from which the core 2' or the mold 2 is formed after curing. The material 7 can, for example, be a ceramic material. According to the invention, the specific electrical conductivity of the mixture 9 and the specific electric conductivity of the material 7 are thereby at least approximately identical in strength, for example, they no longer differ like in phase 2 in FIG. 2 so that, in the material 7 and the mixture 9, essentially the same specific electrical conductivity and the same specific electrical resistance prevail. The mold or core tool 1 according to the invention furthermore possesses at least two electrodes 10, which are arranged in parallel to one another. A device 8 is provided to regulate and control the voltage supplied to the electrodes 10.

According to the invention, now, the specific electrical conductivity of the material 7 of the core 2' or of the mold approximately correspond to the specific electrical conductivity of the mixture 9 in phase 2 in FIG. 2, whereby a comparably even channeling of electrical energy through the mixture 9 is possible.

With the mold or core tool 1 according to the invention, a mold 2 or a core 2' or a foundry core 2' can be produced at the highest level of quality possible since, due to the at least approximately same electrical conductivity of the mixture 9 and the material 7 used for the mold 2 or the core 2', an even channeling of electrical current through the material 7 and the mixture 9 and thereby, an even heating and curing of the mixture 9 can take place and that being independent of the respective geometrical dimensions of the mold 2 or of the core 2'.

Thereby, the mold 2 or core 2 is produced as follows: First, after the aforementioned selection of materials during the first construction, the electrically conductive material 7 is inserted into housing 3 of the mold or core tool 1 and forms a negative mold for the mixture 9 forming the later mold 2 or the later core 2'. Subsequently, electrical energy and thereby heat is supplied to the material 7 via the electrodes 10, which result in a curing of the mixture 9. A curing of the mixture 9 thereby takes place, in particular, by means of evaporating water from the mixture 9, wherein the mixture 9 can, for example, contain an inorganic binder, water and foundry sand.

The inorganic binder used in the mixture 9 (sand/binder mixture) can be water soluble, but at least contain water and is, in any case, electrically conductive. Using the method according to the invention and the mold or core tool 1 according to the invention, a particularly evenly heated and thereby also particularly evenly cured and therefore more homogeneous foundry core or core 2' can be created and that being independent of the respective geometrical dimensions of the core 2' or of the mold 2, since, the electrical current does not seek out any shorter routes due to the preferably identical electrical conductivity of the mixture 9 for the core 2' and of the material 7, as has been the case up until this point with known mold or core tools known from prior art. Up until this point, this had resulted in the fact that, due to the electrical paths caused by the geometrical dimensions of the core 2' or the mold 2, under certain circumstances, up until this point, these had not been evenly cured and, therefore, had regions that were fully cured and regions that were only partially or not cured at all, whereby the quality of the molds or cores manufactured up and to this point using the mold or core tools up until this point were often unsatisfactory.

By means of the device 8, in particular, the voltage can be increased or decreased, whereby a cycle time for producing the mold 2 or the core 2' can be controlled.

The base plate of the tool 12 takes up the housing 3 and the parts 4, 5 as well as the material 7 and insulation screws 13 and brackets 14 provide for an attachment. Insulation screws 13 can also be replaced by rapid-clamping systems to make easier and faster expansion possible. The material "floats" on the electrode 10 and electrode 10 is held in its position by alignment pins 15.

In the following, Table 1 is included for the sake of a better understanding. Thereby, Table 1 shows a plurality of measurement series with different sand/binder mixtures 9. Thereby, the findings entail that the specific electrical conductivity depends on the desired sand/binder mixture 9 and that it can be influenced by varying additives and/or by changing the percentage of the components it consists of. The stronger the electrically conductive proportion is in the sand/binder mixture 9, the lower the specific electrical resistance in the sand/binder mixture is 9.

TABLE 1

Sand/binder mixtures measurement series

| Measurement series | Specific sand heat | Surface, Test body $cm^2$ | Height, Test body $cm^2$ | Lowest measured resistance (optimum point) ohm |
|---|---|---|---|---|
| Water glass 2% | 0.835 J/g*K | 6.1 | 2 | 1080 |
| Water glass 3% | 0.835 J/g*K | 6.1 | 2 | 1130 |
| Water glass 3% and graphite 0.5% | 0.835 J/g*K | 6.1 | 2 | 588 |
| Water glass 3%, graphite, 1%, measurement series 1 | 0.835 J/g*K | 6.1 | 2 | 529 |
| Water glass 3%, graphite, 1%, measurement series 2 | 0.835 J/g*K | 6.1 | 2 | 498 |
| Water glass 4%, measurement series 1 | 0.835 J/g*K | 6.1 | 2 | 523 |
| Water glass 4%, measurement series 2 | 0.835 J/g*K | 6.1 | 2 | 584 |
| Water glass 10% and graphite 5.0% | 0.835 J/g*K | 6.1 | 2 | 12.78 |
| Innotek Binder by ASK | 0.835 J/g*K | 6.1 | 2 | 781 |
| Cordis binder by Hüttenes Albertus | 0.835 J/g*K | 6.1 | 2 | 683 |
| Foundry binder (undisclosed) | 0.835 J/g*K | 9.6 | 3.5 | 499 |

Therefore, the following approach is used to determine the specific electrical property of the desired sand/binder mixture. However, this method can also be used if the (sand/binder) mixture 9 has not yet defined. In this case, an attempt can be made to specifically influence the specific electrical property of the sand/binder mixture 9 by means of varying the additives in order to improve the efficiency of the method.

Several steps are necessary to optimally select electrically conductive materials for this method. Each binder has an optimal operating temperature that ensures the best possible curing. For the tested binders, this was about 150-180° C. and depends on the manufacturer's specifications as well as, possibly, the binder additives used. First, the specific resistance curve of the desired inorganic sand/binder mixture 9 must be determined depending on the temperature. In Table 1, as an example, select resistance temperature values for sand/binder mixtures based on inorganic binders and binder variations are shown. Thereby, different percentages of soluble glass as well as graphite additives were also analysed. The curves were determined as follows:

Initially, a comparative sample body must be created. The sample body consists of two opposite metallic electrodes and an insulation tube between the electrodes. Geometry (area and spacing of the electrodes) of the body within the insulation tube must be determined. The cavity is filled with a green non-curing sand/binder mixture 9. During production, the sand/binder mixture 9 muss correspond to the mixture 9 to be used later on. The mixture 9 must be compressed in accordance with real application conditions. Measuring devices are connected to the electrodes to determine the voltage, electrical current and temperature. A constant voltage is applied to the electrodes via a current supply. The calculated resistance results from the applied voltage divided by the measured electrical current.

A calculation of the temperature-dependent specific resistance takes place as follows:

$$Rho=R*A/I$$

with

Rho: specific electrical resistance of the mixture.

R: Resistance before the increase of electrical resistance of the sample

A: Electrode surface of the mixture

I: Thickness of the sample

Thereby, a temperature-dependent resistance curve results for each sand/binder mixture 9.

All measured resistance curves thereby comprise the following characteristic shape like in FIG. 2.

In FIG. 2, the typical progression of the electrical resistance and the introduced electrical power of a conductively heated mixture 9 of any inorganic sand/binder mixture is shown. After the voltage has been switched on, the resistance decreases significantly within a very short period of time (phase 1: capacitive load). After that, phase 2 of the slowly dropping electrical resistance begins in the curve progression (load carrier increase). During this time, the power absorbed by the sample also continuously increases until load carriers evaporate due to the temperature reached. The resistance now increases very quickly (phase 3). For the selection of the specific electrical resistance (Rho) of the ceramic material for a later mold, the point in time before the increase in electrical resistance of the sample is optimal in phase 3 since, here, the greatest amount of power can be introduced (shortly before the end of phase 2). This is indicated in FIG. 2 with 11.

Furthermore, specific electrical resistance resulting from the calculation of values within phase 2 is conceivable.

The specific electrical resistance of the tested mixtures 9 changes during the heating process. It is under 100° C. at approx. 85 ohmmeters and falls under 25 ohmmeters at over 130° C. Upon further heating, the specific resistance erratically increases. Then, however, the necessary energy to remove the water from the binder, which leads to curing, is also present in the sand/binder mixture 9.

In the case of another favourable embodiment of the solution according to the invention, the inorganic binder can also be replaced with other binder types, provided that these are electrically conductive and require heat for curing as well as have the characteristics that are otherwise required.

For the optimal selection of electrically conductive materials for this method, after determining the temperature/resistance curve of the sand/binder mixture 9, the determination of the material 7 is possible based on the required specific resistance.

Based on the specific resistance of the sand/binder mixture 9, a material composition must be determined by a series of tests, which has a suitable specific electrical resistance at a certain temperature. This certain temperature depends on the optimal temperature required by the binder to best cure.

In our experiments, tested binders required temperatures ranging from approx. 150° C. to about 180° C. to cure. The range around the optimal resistance was determined to be about 25 ohmmeters by means of the temperature resistance curve (see above). Consequently, the tested binder mixture 9 requires a material 7 with a specific resistance of about 25 ohmmeters at 150-180° C.

Principally, the specific resistance of the material 7 should be the same with relation to the optimal specific resistance for the sand/binder mixture 9. During implementation, if the specific resistance of the material 7 should be over that of the sand/binder mixture 9, this tends to result in a heating of the centre of the core 2 in the direction of the core-box material 7, since, here, the current seeks out the route with the lower level of resistance. During implementation, if the specific resistance of the material 7 should be lower than in the sand/binder mixture 9, the heating of the core-box material 7 tends to take place in the direction of the sand-core centre.

Likewise, the progression of the temperature/resistance curve of the material 7 should similarly to the temperature/resistance curve of the temperature/resistance curve of the sand/binder mixture 9. The smaller the deviation of both curves is, the more effective the method is.

Thereby, the test series to determine the material can carried out as follows:

A source material, such as silicon carbide, is produced in the form of a small sample plate. This material sample is then clamped into an apparatus between two electrodes so that these electrodes are in direct contact with the sample plate. Then, the temperature resistance curves for this test material is determined. If the deviation between the specific resistance of the sample material and of the optimal specific resistance of the sand/binder mixture 9 is too great, the material composition must be revised. In tests carried out, silicon carbide compositions with a variation of the graphite content in the ceramic mixture have proved positive. But in principle, other material compositions or material additives that influence the electrical specific resistance are also possible. Thereby, the graphite content is bound in the ceramic and thus has no influence on further casting processes.

These tests must be repeated as long as a suitable material composition has been found, which has the desired specific resistance.

Furthermore, the selected material 7 must also fulfil the other physical characteristics for foundry environments. For example, breaking strength, surface roughness, thermal expansion and thermal conductivity are mentioned here.

For example, the ceramic selected for other tests upon reaching the required operating temperature of approx. 180° C. has a specific resistance of approx. 30 ohmmeters for the above-mentioned sand/binder mixture 9.

Then, the maximum short-term stress of the material 7 must be determined where no permanent damage to material 7 occurs. This maximal short-term load plays an important role for the electrical control in the following. This is determined by means of stress tests and can lead to spalling on the material 7 if the maximum short-term load is exceeded.

In the case of another favourable embodiment of the solution according to the invention, the aforementioned and the following material 7 can be replaced by other materials provided that these are electrically conductive, and the adaptation of the specific electric resistance corresponds to the selected mixture 9 and also the other foundry operations requirements are fulfilled.

The repeated term "adaptation" describes the aforementioned steps of selecting a suitable material 7 to the specifically electrical characteristics of sand/binder mixtures 9. After the selection (adaptation) of the suitable material 7 according to the method described above was successful and has been adapted to the sand/binder mixture 9, the structure of the core box can be established for the application of the method. Thereby, the most critical work step is the production of the material 7. In the aforementioned silicon carbide ceramic as an example, the ceramic is produced in several production steps according to common ceramic production processes. In particular, the fine processing after sintering requires a great amount of attention due to the very hard material (Mohs hardness of approx. 9.5). The more precise the fine processing takes place, the lower the later tolerance deviations are for the sand cores 2 produced by means of the method.

Once the fine processing of the material 7 has been successfully completed, the attachment can take place in the core box. The material 7 requires a direct contact surface with the respective electrode on the opposite side of the contouring surface. In tests, it has been suggested to grind the contact surfaces to be level in order to enable a very good contact between the electrode 10 and the material 7. This leads to the desired effect of keeping the transition resistance levels low in the process.

As shown in FIG. 4, the electrode 10 should be laid floating on the back of the material part. This is necessary because the material of the electrodes 10 usually has a higher heat expansion than the core-box material. For this purpose, two pins are attached on the back side of the material, which hold the electrodes 10 in position during the production process.

Due to the parallel arrangement of the electrodes 10, a comparably even channeling of electrical energy through the material 7 and the mixture 9 can be achieved, whereby, in turn, advantages result with regard to an even heating and an even curing. A possible embodiment also provides for electrodes 10 to be introduced into the material 7. In this case, no pins are required for alignment. The electrodes 10 and material 7 will then be received by a depression in an insulating material.

The attachment of the multi-layer levels can be done by anchoring them in the base plate 12 of the tool. For the attachment, angles 14 with screw connections 15 can be used, as is exemplified in FIG. 5. In order to enable a quick replacement of individual materials, a rapid closure system can also be used instead of screws.

The attachment screws 15 should be made out of a non-conductive material in order to avoid carrying current to the housing 3 In addition, ventilation slits 17 (orifices) must be provided within the material 7, in the electrodes 10, as well as in the housing 3 in order to make the escape of gases or water vapour possible. As is the case with existing methods, during the curing process, resulting gases and water vapour can be discharged by means of core prints (orifices) out of the sand core 2" (core) and the material 7, the electrodes 10 and the housing 3 via holes 17. Alternatively, the material can also be porous and thus allow the gases or water vapour to escape.

The electrodes 10 require a power supply, which is connected to the external control cabinet and thus allows for electrical control 8 to take place.

The electrical control 8 must be adapted to the core box as well as the method. The electrical control 8 takes on the task of providing the core box with a sufficient amount of energy by means of guiding current and electrodes 10. In the case of new plants, the electrical control 8 (device 8) must be planned along with accordingly. When modifying current systems to the new method, under certain circumstances, existing switchgear must be converted and adapted. It is important that the energy supply into the material 7 takes place via electrodes 10. Thereby, an alternating or direct current is conceivable.

The control of the current guidance must take the maximum short-term stress of the selected material 7 as well as the resistance/temperature curve of the material 7 and of the sand/binder mixture 9 into account.

The electrical control 8 must be selected in such a way that a highest power input as possible takes place by means of a high voltage, however, the maximum short-term stress limit is never exceeded in order to prevent damage to the material 7, thereby ensuring an economic method. The power input and the associated heat development into the sand/binder mixture 9 depends on the specific resistance as well as the applied voltage. Therefore, the power input and the temperature can be also be controlled by regulating the voltage. In addition, the core box should have temperature sensors in order to avoid a heating above the prescribed working region of the binder since a temperature that is too high would otherwise negatively influence the binding force.

Thereby, the electrical control 8 also regulates the various process steps of the core shooter. Thereby, particularly when moving the core-box parts together, it must be paid attention to that the compiling takes place at an adapted tempo in order to avoid an impact within the core-box material and thereby, possible permanent damage.

For core tools with multiple sand cores 2, either one pair of electrodes per sand core 2" can be used or one pair of electrodes that cover all sand cores 2 of the complete core box. Thereby, it must be taken into consideration that, during the heating process, the control must be selected in such a way that all send cores 2 can cure in the desired cycle time, however also, that the temperature in the sand core 2" never increases beyond the point at which the binder loses its binding force.

Other apparatuses for the external heating of core boxes can be done without. Other apparatuses. for pressure ventilation for example, can continue to be used.

Thereby, the regular production process is divided into three processes. The first process describes the commissioning of the plant following a brief or longer period of downtime.

One feature during this process is that material 7 has not yet reached the planned operating temperature. Thereby, heating of the core box takes place like it also does in the case of the typical production process. The parts 4, 5 are led together from their initial position and form a contact surface. Then, the sand/bind mixture 9 can be shot into the core boxes. At the next step, the energy supply then takes place by means of current thanks to the electrical control 8. Due to increased specific resistance of material 7, the warm-up process takes a little longer than the regular production cycle times. During the heating process, the core box heats slowly and as the temperature increases, the specific resistance of the material 7 decreases. The stronger the resistance falls, the faster the material 7 heats up according to the principle of resistance heating. Since the heat input for the first sand cores 2 does not take place under optimal conditions, there may be an increased scrap during this process.

Once the desired operating temperature for the binder at the core box has been reached, the actual production process begins. Thereby, the process parameters can be described as follows. The material 7 of the core box is at operating temperature and thus, it has the optimal specific resistance of the sand/binder mixture 9. The core box parts 4, 5 are moved apart from each other and the sand core cavity is empty. At the first step, the core box parts 4, 5 are closed and then the sand/binder mixture 9 is shot into the core boxes. The specific resistance depends on the temperature of the sand/binder mixture 9. Thereby, the mixture 9 can be at room temperature or already be preheated. Once the sand/binder mixture 9 has been shot into the core boxes, the direct contact surface to the sand/binder mixture 9 of the core-box material somewhat cools down. Thereby, the resistance of the core-box material 7 briefly increases, wherein, at the same time, the specific resistance of the sand/binder mixture 9 decreases thanks to heat absorption. Since, as described in the above, the temperature/resistance curves of the material 7 and of the sand/binder mixture 9 progress in a similar manner, the deviation of the specific resistance remains limited The electrical control 8 activates the current flow and this leads to a current flow through the material 7 as well as through the sand core 2". As the heat increases, the resistance of the sand/binder mixture 9 as well as in the material 7 decreases until the optimal resistance has approximately been achieved. At this moment, the power input is optimal.

Within a few seconds, the sand/binder mixture 9 is now heated from its initial temperature to approximately 100 to 130° C. depending on size. Once the free load carriers are reduced due to evaporating the water content within the sand/binder mixture 9, the specific resistance of the sand/binder mixture 9 begins to promptly increase. At this moment, the power flow is reduced within the sand core 2. In order to reach the desired optimal operating temperature for the send/binder mixture 9, the remaining heat energy must be transferred via the core-box material 7 as is also the case with existing methods.

In tests carried out, the silicon carbide material is furthermore continuously heated by means of a current flow in order to compensate for the heat loss of the material 7 on the sand core 2".

The particular advantage of the method is therefore particularly in heating of the sand/binder mixture 9 from the temperature during injection up until approximately 130° C. by means of the principle of resistance heating by means of current flow within the sand core 2. The other advantage is the efficient heating of the material 7 and, thereby, the heat supply during the phase from 130° C. to the desired operating temperature of the sand/binder mixture 9.

As an example, a sand/binder mixture 9 with an operating temperature of approx. 170° C. and an injection temperature of about 20° C. is used. In total, a temperature of approximately 150° C. is required for heating. By means of the method, therefore, ⅔ (approx. 100° C.) of the required heat energy can be generated very quickly by means of resistance heating within the sand core 2 and approximately ⅓ by means of heat transfer of the material 7 to the sand core 2".

After reaching the operating temperature and curing, the sand core 2" can be removed as is the case with core-shooting methods. Required ejection pins 16 for ejecting the sand core from the cavity are attached in the designated ejection holes 16' and make the loosening of the sand cores 2 from the material 7 possible.

The third process describes the cooling phase before a break or shut down. At this phase, the core box can simply cool down in the moved-apart state and then the first process step is available again.

In comparison to the methods known from prior art up until this point, where it must continuously be feared that the mixture 9 has a different local degree of curing due to different internal electric resistances, for example, caused by different sand-core thicknesses, for the first time, an even, meaning a uniform and additionally process-reliable curing of the mixture 9 can be achieved by means of the method according to the invention, wherein molds 2 or foundry cores 2' can be produced having a particularly high level of quality independent of their geometrical structure. Furthermore, by means of the method according to the invention, the danger of scaling on a core surface or a mold surface is prevented, which, for example, would be the case when curing by means of heat from the outside (e.g. oil heating).

For the first time, by means of the mold or core tool 1 is thereby, a process-reliable production of molds 2 or cores 2' is possible by means of the adaptation of the specific electrical conductivity of the mold/core-box material 7 to the sand/binder mixture 9. This allows for the even channeling of electrical energy to take place and, therefore, to even heating, thus resulting in even curing. This has not been possible up until this point.

The invention claimed is:

1. A method for producing molds or cores for foundry purposes by means of adapting the specific electrical resistance of the material of the tool insert to the specific electrical resistance of a mixture consisting of at least one molding material, in particular, foundry sand, and at least one inorganic water-containing binder that can be cured by means of heat, which has an electrical conductivity of at least 5·10-3 S/m, wherein:

at least one tool insert made of an electrically conductive material for holding the mixture is introduced into an electrically non-conductive housing, wherein the electrical conductivity of the material at an operating temperature between 150 and 180° C. at least approximately corresponds to the specific electrical conductivity of the mixture at a temperature between approximately 100° C. to 130° C., electrical energy and heat is supplied to the tool insert via electrodes that are arranged in parallel in/on the housing, leading to the curing of the mixture, wherein the housing is made of at least two housing parts, which are movable together or apart from each other at the beginning and upon completion of the cycle process of the mold or core production and form a direct contact surface when moved together, wherein holes for ejection pins are provided within the tool, belonging to at least one electrode as well as to at least one part of the housing for removing the sand core, wherein both the tool as well as the electrodes as well as at least one part of the housing are porous and/or ventilation slits are present for the escape of water vapor or gases, and wherein the mold(s) or the core(s) are pressed out of the tool and removed by means of ejection pins after curing of the mixture and moving apart the housing parts, characterized in that a material is used for tool inserts which has the following characteristics:

(1) it comprises a sintered solid body, which has a Mohs hardness of more than 4, wherein (2) the specific electrical resistance of the material is between 0.5 ohmmeters and 200 ohmmeters at an operating temperature of 150° C. to 180° C., and, (3) the heat conductivity is at least 0.56 W/(m*K).

2. The method according to claim 1, characterized in that the electrical energy in the form of alternating current or direct current is supplied to the tool insert, the electrical voltage is regulated by means of a device for controlling/regulating, taking the specific temperature/resistance curve of the sand/binder mixture, the temperature of the tool insert as well as the maximum short-term stress load of the tool insert material under consideration.

3. The method according to claim 1, characterized in that a sintered ceramic material containing silicon carbide or silicon nitride is used as a material.

4. The method according to claim 1, characterized in that for the method for producing molds or cores, at least one tool insert with at least one cavity is used for the mold to be produced or the core to be produced.

5. The method according to claim 1, characterized in that the ejection pins for ejecting the sand cores are made of non-conductive material or are used on a technical constructive level in such a way that conductive ejection pins do not come into contact during the production process of the molds or cores with the electrically live components of the core box.

6. The method according to claim 1, characterized in adding additives, such as graphite or table salt for example, such that the electrical conductivity of the mixture is influenced in such a way that a lower specific resistance is achieved.

* * * * *